US009274483B2

(12) United States Patent
Kiuchi et al.

(10) Patent No.: US 9,274,483 B2
(45) Date of Patent: Mar. 1, 2016

(54) IMAGE FORMING APPARATUS, IMAGE FORMING METHOD, AND COMPUTER READABLE MEDIUM HAVING IMAGE DENSITY ADJUSTMENT CONTROL

(71) Applicant: FUJI XEROX CO., LTD., Tokyo (JP)

(72) Inventors: Yutaka Kiuchi, Ebina (JP); Kazuhiko Arai, Ebina (JP); Kunihiko Sato, Ebina (JP); Sakon Takahashi, Minamiashigara (JP); Masayo Higashimura, Ebina (JP); Kosuke Yamada, Ebina (JP); Atsumi Kurita, Ebina (JP); Daisuke Nakai, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/202,364

(22) Filed: Mar. 10, 2014

(65) Prior Publication Data

US 2015/0071671 A1 Mar. 12, 2015

(30) Foreign Application Priority Data

Sep. 10, 2013 (JP) ..... 2013-187432

(51) Int. Cl.
*G03G 15/00* (2006.01)
*G03G 15/10* (2006.01)

(52) U.S. Cl.
CPC ..... *G03G 15/5062* (2013.01); *G03G 15/556* (2013.01); *G03G 15/652* (2013.01)

(58) Field of Classification Search
CPC ..... G03G 15/50; G03G 15/5062; G03G 2215/0161
USPC ..... 399/72, 49
See application file for complete search history.

(56) References Cited

U.S. PATENT DOCUMENTS

| | | | | |
|---|---|---|---|---|
| 2006/0233561 | A1* | 10/2006 | Yamaoka | 399/49 |
| 2008/0187384 | A1 | 8/2008 | Yamamoto | |
| 2009/0003865 | A1* | 1/2009 | Endou et al. | 399/66 |

FOREIGN PATENT DOCUMENTS

| | | | |
|---|---|---|---|
| JP | A-2004-053857 | | 2/2004 |
| JP | A-2006-084822 | | 3/2006 |
| JP | 2006-091179 | A | 4/2006 |
| JP | 2008-149657 | A | 7/2008 |
| JP | A-2008-191215 | | 8/2008 |
| JP | 2008-225354 | A | 9/2008 |
| JP | 2011170009 | A | 9/2011 |

OTHER PUBLICATIONS

Oct. 14, 2014 Office Action issued in Japanese Patent Application No. 2013-187432.
Jan. 6, 2015 Office Action issued in Japanese Application No. 2013-187432.

* cited by examiner

*Primary Examiner* — Billy Lactaoen
(74) *Attorney, Agent, or Firm* — Oliff PLC

(57) ABSTRACT

An image forming apparatus includes an image forming unit and a controller. The image forming unit forms an image on a continuous recording medium by transferring to the continuous recording medium a toner image obtained by developing a latent image formed on a photoreceptor. The controller controls the image forming unit such that an image based on image information is formed in a specific image area on the continuous recording medium, and at the same time, a specific image pattern is formed in a specific side area outside the image area on the continuous recording medium.

18 Claims, 7 Drawing Sheets

IMAGE FORMING APPARATUS, IMAGE FORMING METHOD, AND COMPUTER READABLE MEDIUM HAVING IMAGE DENSITY ADJUSTMENT CONTROL

CROSS-REFERENCE TO RELATED APPLICATIONS

This application is based on and claims priority under 35 USC 119 from Japanese Patent Application No. 2013-187432 filed Sep. 10, 2013.

BACKGROUND

Technical Field

The present invention relates to an image forming apparatus, an image forming method, and a computer readable medium.

SUMMARY

According to an aspect of the invention, there is provided an image forming apparatus including an image forming unit and a controller. The image forming unit forms an image on a continuous recording medium by transferring to the continuous recording medium a toner image obtained by developing a latent image formed on a photoreceptor. The controller controls the image forming unit such that an image based on image information is formed in a specific image area on the continuous recording medium, and at the same time, a specific image pattern is formed in a specific side area outside the image area on the continuous recording medium.

BRIEF DESCRIPTION OF THE DRAWINGS

An exemplary embodiment of the present invention will be described in detail based on the following figures, wherein.

DETAILED DESCRIPTION

Figure 1:
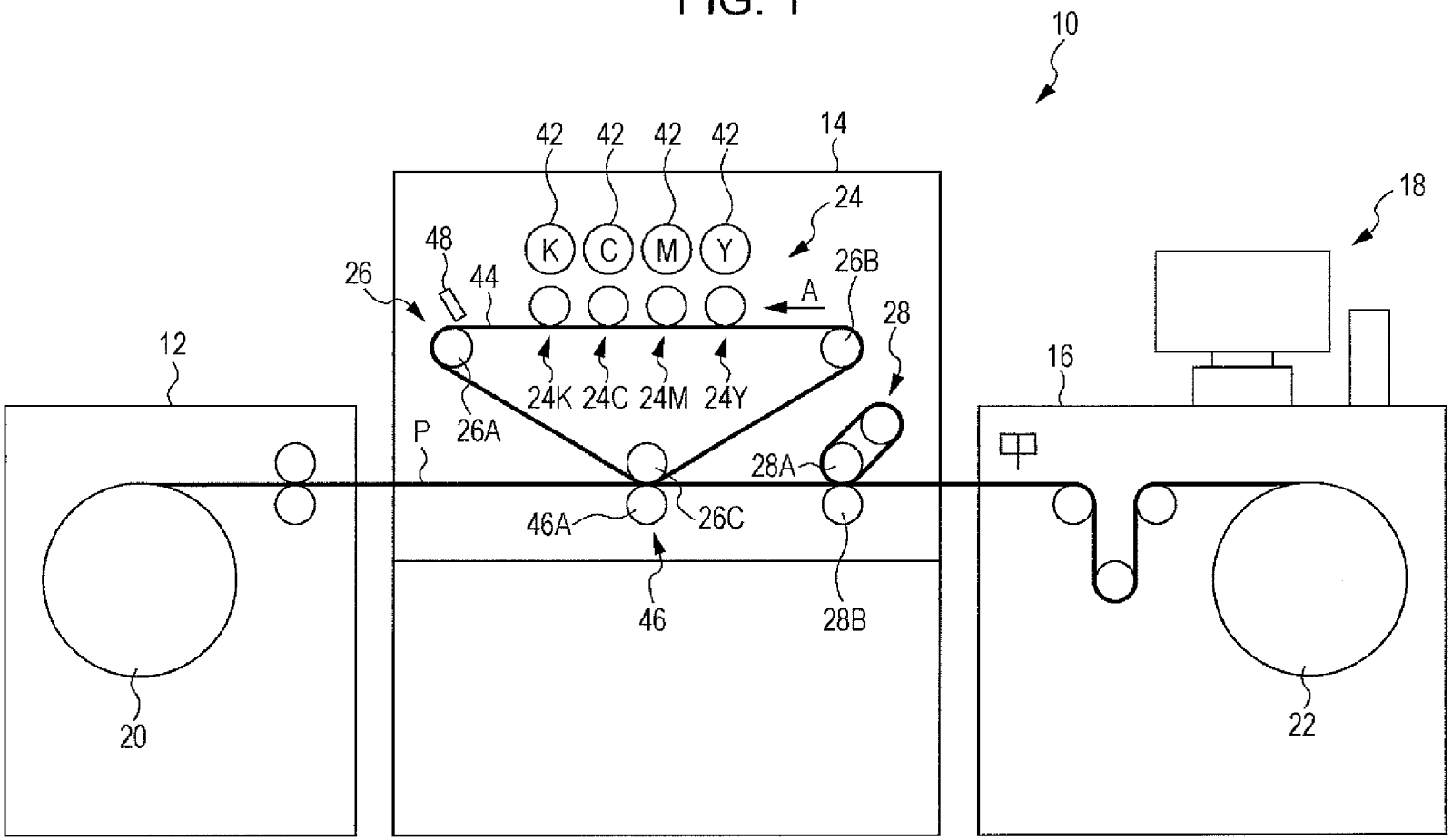
FIG. 1 is a diagram illustrating a schematic configuration of an image forming apparatus according an exemplary embodiment.

Hereinafter, an exemplary embodiment of the present invention will be explained with reference to the drawings. FIG. 1 is a diagram illustrating a schematic configuration of an image forming apparatus 10 according to this exemplary embodiment of the invention.

As illustrated in FIG. 1, the image forming apparatus 10 according to this exemplary embodiment includes a paper feeder 12 that feeds a continuous recording medium, which is, for example, paper, an image forming device 14 that forms an image on the continuous recording medium fed by the paper feeder 12, a storage device 16 that stores the continuous recording medium on which an image is formed by the image forming device 14, and a controller 18 that controls each of the paper feeder 12, the image forming device 14, and the storage device 16.

The paper feeder 12 feeds long, continuous paper P as a continuous recording medium, and the storage device 16 stores the continuous paper P on which an image is formed by the image forming device 14.

Figure 2A:
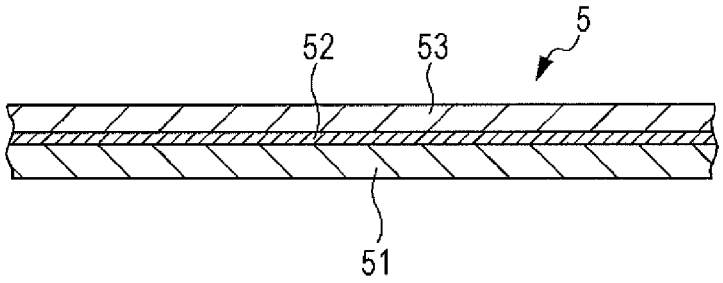
FIGS. 2A, 2B, and 2C are sectional configuration diagrams illustrating label paper.
Figure 2B:
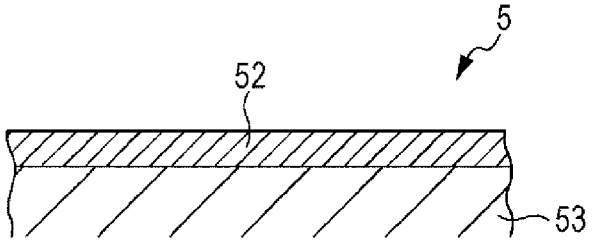
Figure 2C:
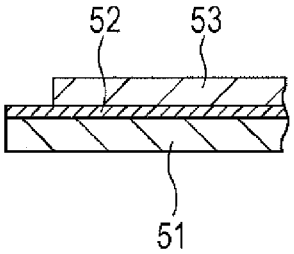

The continuous paper P is, for example, paper made of a synthetic resin such as PP (polypropylene), glassine, or high-quality paper. In general, as illustrated in FIGS. 2A, 2B, and 2C, so-called label paper 5 is used as the continuous paper P, in which a surface base material 53 which is arranged as an uppermost layer is adhered, via an adhesive layer 52 which is made of adhesive material such as glue and is arranged as an intermediate layer, onto release paper 51 which serves as a mount and is removed at the time of usage. Patterns and characters are printed on the surface base material 53. Depending on the usage, the label paper 5 may, for example, be arranged as rolled paper with the surface base material 53 side of the label paper 5 being positioned as an image forming surface (outer peripheral surface) of the roll.

The paper feeder 12 includes a paper feed roll 20 which is made of the continuous paper P taken up into a roll. With a driving unit which is not illustrated, the paper feed roll 20 is rotationally driven, and the continuous paper P is fed into the image forming device 14.

Furthermore, the storage device 16 includes a storage roll 22 which is made of the continuous paper P on which an image is formed, taken up into a roll.

The image forming device 14 forms an image on the continuous paper P using toners in four colors, yellow (Y), magenta (M), cyan (C), and black (K), based on image information. The image forming device 14 includes an image forming unit 24 which forms a toner image developed by toners which configure developer, an intermediate transfer unit 26 which carries each toner image formed by the image forming unit 24 and conveys the toner image to a secondary transfer location where secondary transfer of the image to the continuous paper P is eventually performed, a secondary transfer unit 46 in which secondary transfer of the toner image to the continuous paper P is performed at the secondary transfer location, a fixing unit 28 which fixes the toner image on the continuous paper P that has been subjected to secondary transfer by the secondary transfer unit 46, and the like.

The image forming unit 24 includes four image forming parts, 24Y, 24M, 24C, and 24K dedicated to formation of toner images in yellow, magenta, cyan, and black, respectively.

Figure 3:
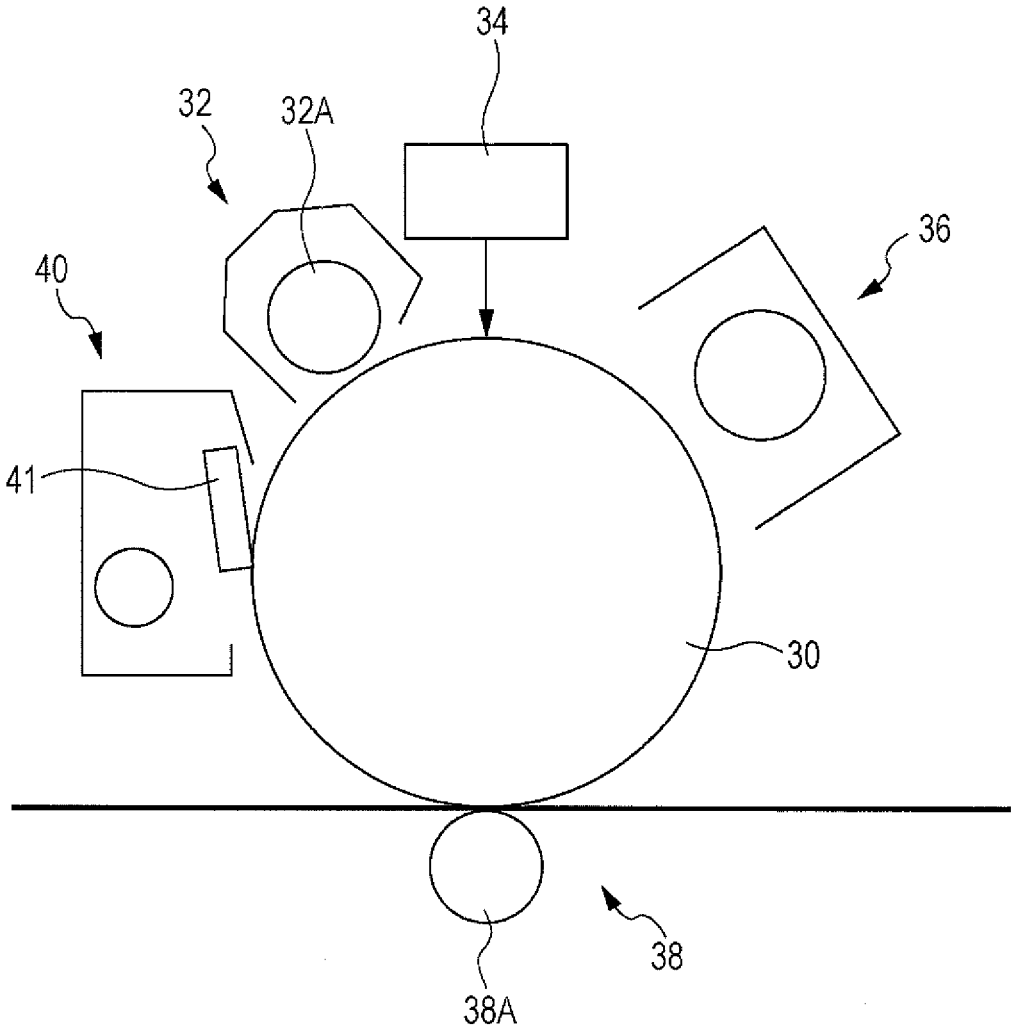
FIG. 3 is a diagram illustrating a schematic configuration of an image forming unit.

The image forming unit 24 includes a corresponding photoconductor drum 30, which is an example of a rotatable image carrier, as illustrated in FIG. 3. A charger 32, an exposure part 34, a developing part 36, a first transfer part 38, a cleaner 40, and the like, each of which will be described later, are arranged around the photoconductor drum 30.

The photoconductor drum 30 has an image holding surface including a photoconductive layer (photosensitive layer) made of photosensitive material on a peripheral surface of a grounded base in a cylindrical or a columnar shape. The photoconductor drum 30 is supported in such a manner that a motive power transmitted by a driving unit, which is not illustrated, allows the photoconductor drum 30 to rotate.

The charger 32 includes a contact-type charging roller 32A which is arranged in contact with the photoconductor drum 30, and charges the peripheral surface on the photoconductor drum 30 on which an image may be formed. Charging voltage is supplied to the charger 32. In the case of the developing part 36 which performs reversal development, a voltage or current having the same polarity as the charging polarity of toner supplied from the developing part 36, is supplied as the charging voltage.

The exposure part 34 applies light based on image information to the peripheral surface of the charged photoconductor drum 30, and forms an electrostatic latent image on the peripheral surface of the photoconductor drum 30.

The developing part 36 generates a toner image by developing an electrostatic latent image formed on the peripheral surface of the photoconductor drum 30 by the exposure part 34, with toner of the developer of a corresponding color. Although not illustrated, the developing part 36 includes a development roller which conveys the developer to a developing area facing the photoconductor drum 30, a stirring and conveying member, such as a screw auger, which conveys the developer to the development roller while stirring the developer, a layer-thickness regulating member which controls the amount of developer held by the development roller, and the like. In the developing part 36, bias voltage for developing is applied in between the development roller and the photoconductor drum 30. Furthermore, the development roller and the stirring and conveying member rotate in a specific direction by transmission of motive power from a rotation and driving unit, which is not illustrated. As a developer, for example, a two-component developer may be used, which contains a non-magnetic toner and a magnetic carrier. As illustrated in FIG. 1, the toner to be supplied to the developing part 36 is supplied from a toner cartridge 42 which stores the developer which contains toner of a corresponding color. Toner used here includes a lubricating external additive. As the lubricating external additive, spherical silica is applied here. However, other substances, such as zinc stearate, polytetrafluoroethylene (PTFE), boron nitride, or the like, may also be applied.

The first transfer part 38 rotates while being in contact with the peripheral surface of the photoconductor drum 30. The first transfer part 38 functions as a contact-type transfer part including a first transfer roller 38A to which first transfer voltage is supplied. By the first transfer voltage being supplied to the first transfer roller 38A, a toner image of each color formed on the photoconductor drum 30 is transferred to the intermediate transfer unit 26. As the first transfer voltage, direct current (DC) voltage having a polarity that is opposite the charging polarity of the toner is applied.

The cleaner 40 cleans the image holding surface of the photoconductor drum 30 by removing deposits such as toner remaining and adhered to the image holding surface after first transfer. In this exemplary embodiment, a blade 41 which is in contact with the photoconductor drum 30 is arranged within the cleaner 40. The blade 41 removes deposits adhered to the peripheral surface of the photoconductor drum 30.

As illustrated in FIG. 1, the intermediate transfer unit 26 is arranged below the image forming unit 24 (the image forming parts 24Y, 24M, 24C, and 24K). In this exemplary embodiment, the intermediate transfer unit 26 mainly includes an intermediate transfer belt 44 which rotates in a direction represented by an arrow A illustrated in FIG. 1 while passing through a first transfer location which is between the photoconductor drum 30 and the first transfer part 38, multiple supporting rollers 26A to 26C which rotatably support the intermediate transfer belt 44, and the secondary transfer unit 46 which performs secondary transfer of a toner image on the intermediate transfer belt 44 to the continuous paper P. Furthermore, although not illustrated, the intermediate transfer unit 26 includes a belt cleaner for cleaning and removing deposits, such as toner or paper dust, adhered to and remaining on the outer peripheral surface of the intermediate transfer belt 44 after passing through the secondary transfer unit 46.

As the intermediate transfer belt 44, an endless belt made of materials in which a resistance adjusting agent, such as carbon black, is dispersed within a synthetic resin, such as a polyimide resin or a polyamide resin, is used. Furthermore, a density sensor 48 to detect the density of a toner image transferred to the intermediate transfer belt 44 is provided on the intermediate transfer belt 44. The supply quantity of the toner is controlled on the basis of the density detection result of the density sensor 48.

The secondary transfer unit 46, as illustrated in FIG. 1, functions as a contact-type transfer unit that includes a secondary transfer roller 46A, which rotates while being in contact with the peripheral surface of the intermediate transfer belt 44 at the secondary transfer location, that is, the outer peripheral surface portion of the intermediate transfer belt 44 which is supported by the supporting roller 26C of the intermediate transfer unit 26, and to which secondary transfer voltage is supplied. Furthermore, to the secondary transfer roller 46A or the supporting roller 26C of the intermediate transfer unit 26, a DC voltage having the polarity the same as or opposite the charging polarity of toner is applied as the secondary transfer voltage. Forward and reverse bias is applied to the secondary transfer roller 46A at a specific timing. The secondary transfer roller 46A is also cleaned by a brush which is not illustrated.

The fixing unit 28 includes a roll-type or belt-type rotatable body 28A for heating which is heated by a heating part so as to maintain the surface temperature at a specific temperature, a roll-type or belt-type rotatable body 28B for pressurizing which rotates by being in contact with the rotatable body 28A with a specific pressure, and the like. In the fixing unit 28, fixing processing is performed by heating and pressurizing a toner image that has been transferred to the continuous paper P by the secondary transfer unit 46.

Figure 4:
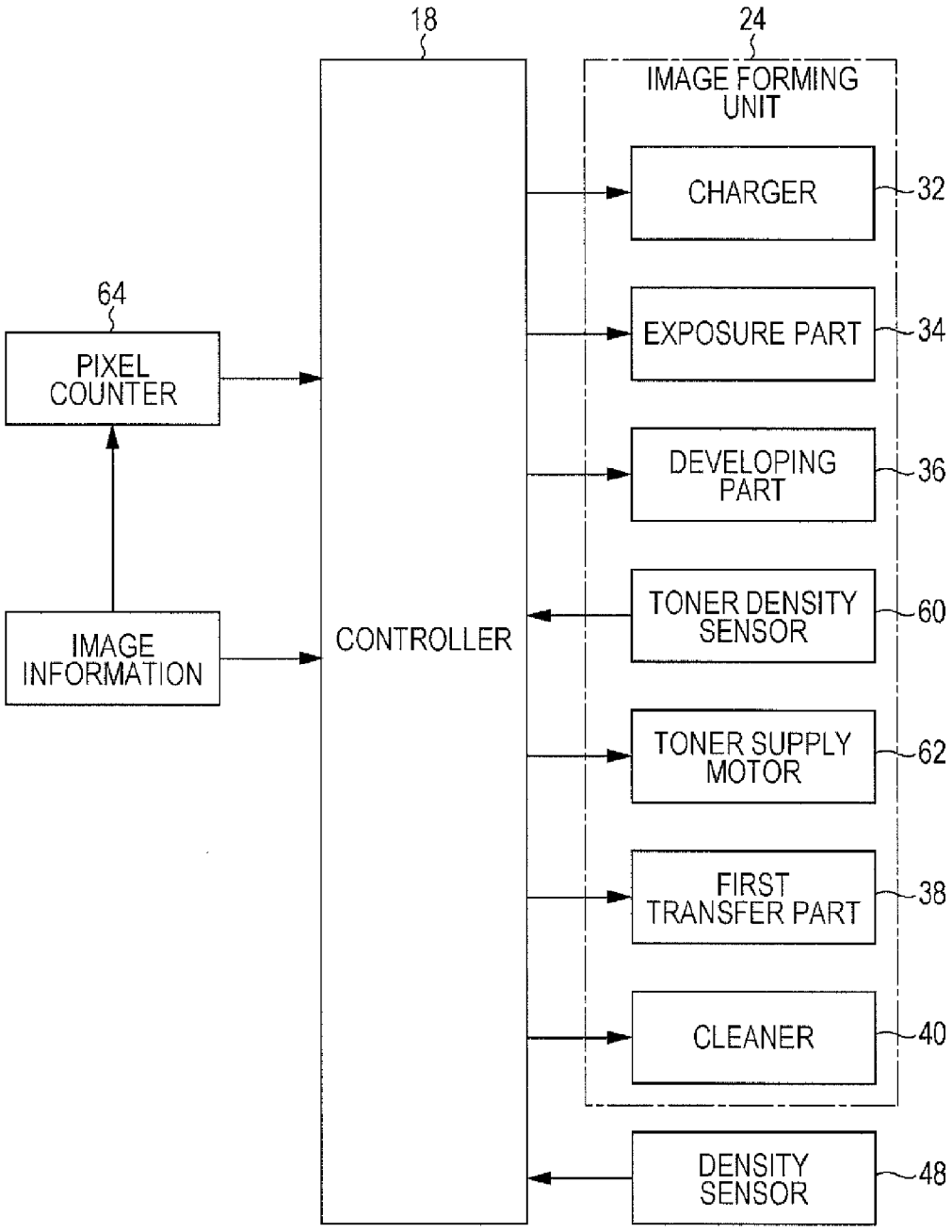
FIG. 4 is a block diagram illustrating a configuration of a control system of an image forming apparatus according to the exemplary embodiment.

Next, a configuration of a control system of the image forming apparatus according to this exemplary embodiment will be explained. FIG. 4 is a block diagram illustrating the configuration of the control system of the image forming apparatus 10 according to this exemplary embodiment. FIG. 4 mainly illustrates the configuration of the control system of the portion that controls the image forming device 14.

As described above, the image forming device 14 is controlled by the controller 18. That is, each component of the image forming unit 24 is connected to the controller 18. More specifically, the charger 32, the exposure part 34, the developing part 36, the first transfer part 38, and the cleaner 40 are connected to the controller 18. Image forming operation is performed by the controller 18 controlling the operation of each component.

Furthermore, the image forming unit 24 includes a toner density sensor 60 that detects the toner density of the developing part 36, and a toner supply motor 62 that supplies toner to the developing part 36 from the toner cartridge 42 to control the toner density. The toner density sensor 60 and the toner supply motor 62 are also connected to the controller 18.

Furthermore, a pixel counter 64 is connected to the controller 18. The pixel counter 64 counts the number of pixels, the image density (area coverage), or the like corresponding to the toner discharge amount, based on image information and the lighting time of the exposure part 34 or the like. The counting result is then input to the controller 18.

As well as controlling the image forming operation, the controller 18 also controls the toner density by controlling the toner supply motor 62 on the basis of the detection result of the toner density sensor 60, the counting result of the pixel counter 64, the detection result of the density sensor 48, and the like.

In the image forming apparatus 10 of such a configuration described above, the charging characteristics may change when the toner degrades, which may affect the image quality.

With the image forming apparatus which forms an image on each piece of cut paper, degradation of toner may be prevented by discharging the toner by forming a specific belt-shaped pattern or the like on the intermediate transfer belt at a timing when the image formation is not performed on paper. However, there is not space enough to form a belt-shaped pattern or the like between images on the continuous paper P. Therefore, it is not possible to discharge the toner in this case.

Figure 5A:
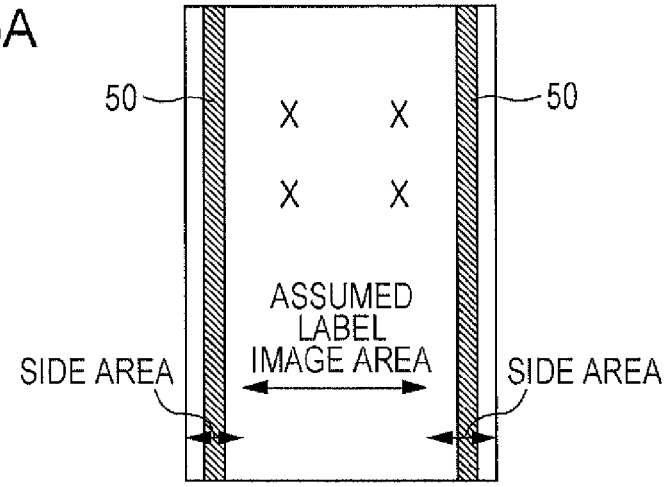
FIG. 5A is a diagram illustrating an example of image patterns formed in side areas.

In this exemplary embodiment, as illustrated in FIG. 5A, by discharging toner outside the image area of the continuous paper P by forming specific image patterns 50 in specific side areas outside the image area of the continuous paper P while forming multiple images x based on image information in the image area of the continuous paper P, the circulation of the toner is urged and the degradation of the toner may be suppressed.

Figure 5B:
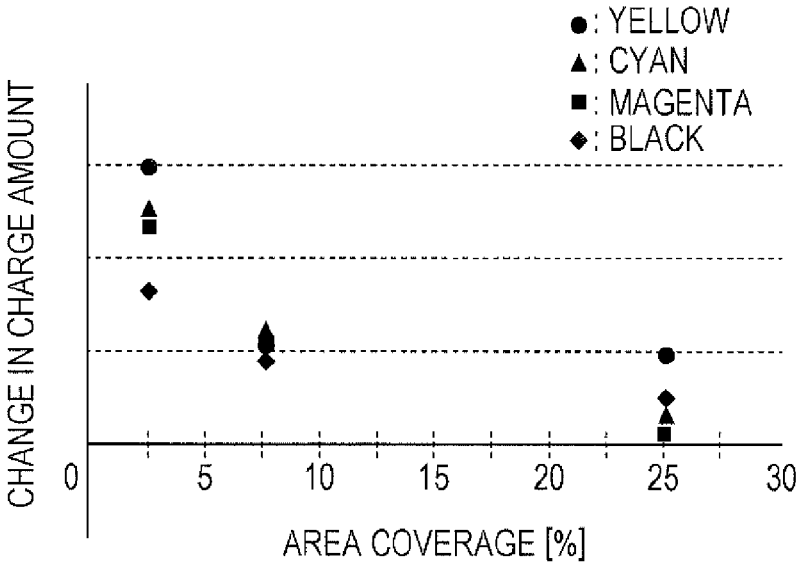
FIG. 5B is a chart illustrating the toner discharge amount and the charge amount change when the image patterns of a band shape are formed on continuous paper of a specific length (page)

FIG. 5B is a chart illustrating the toner discharge amount (area coverage) and the charge amount change when forming image patterns 50 in a band shape on the continuous paper P of a specific length (page) under specific conditions. Symbols in the chart represents different colors, for example, the black circle represents yellow, the black triangle represents cyan, the black square represents magenta, and the black diamond represents black. The vertical axis of FIG. 5B represents a change in the charge amount when forming the image patterns 50 on the continuous paper P of a specific length (page) with respect to the charge amount at the time when the image formation starts.

As illustrated in FIG. 5B, when the area coverage corresponding to the toner discharge amount is small, the change in the charge amount between before and after formation of an image of the specific length is large, and when the area coverage is large, the change in the charge amount is small. Therefore, it is understood that when the area coverage (toner discharge amount) is small, the toner degrades and the charge amount change is large.

In this exemplary embodiment, the area coverage is detected by the pixel counter 64 or the like, and for example, by the controller 18 controlling the image forming device 14 to form the image patterns 50 that provide an area coverage equal to or greater than a specific threshold (for example, 3 percent) in side areas, the degradation of the toner is suppressed. In this exemplary embodiment, by adjusting the size of the image patterns 50, the area coverage is increased to be equal to or greater than the threshold.

Figure 5C:
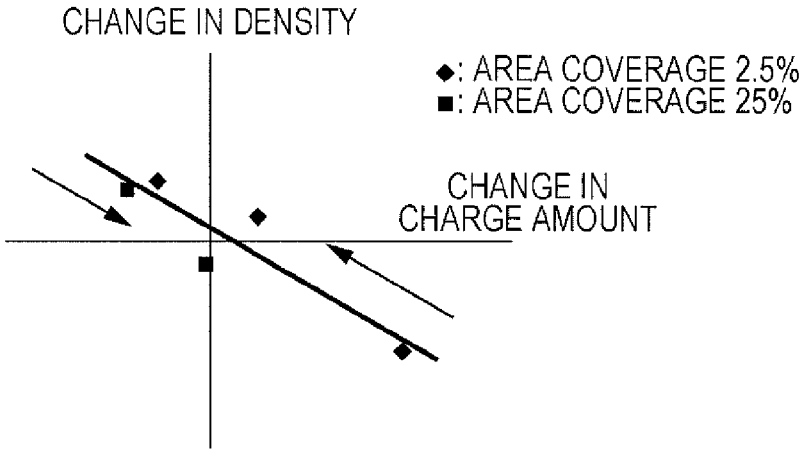
FIG. 5C is a diagram illustrating a change in the density with respect to a change in the charge amount.

As described above, by forming the image patterns 50 and discharging the toner, as illustrated in FIG. 5B, the change in the charge amount decreases. When the change in the charge amount decreases, the change in the density also decreases as illustrated in FIG. 5C, and therefore the image quality becomes stable. FIG. 5C is a diagram illustrating a change in the density with respect to a change in the charge amount. In FIG. 5C, the black diamond represents an area coverage of 2.5 percent, and the black square represents an area coverage of 25 percent.

The amount of toner to be discharged may be changed by changing the width, length, image density, or the like of the image patterns 50, according to the area coverage detected by the pixel counter 64 or the like.

Figure 6A:
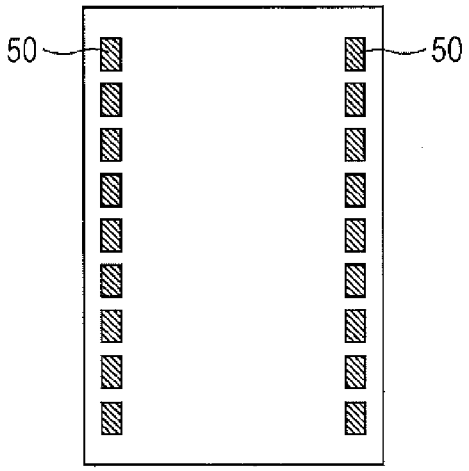
FIG. 6A is a diagram illustrating an example of the image patterns of a block shape.
Figure 6B:
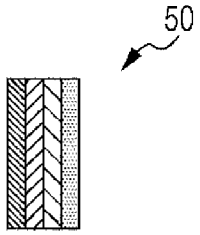
FIG. 6B is a diagram illustrating an example of the image patterns of four colors that do not overlap.
Figure 6C:
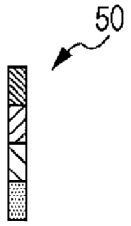
FIG. 6C is a diagram illustrating another example of the image patterns of four colors that do not overlap.

As for the shapes of the image patterns 50 to be formed in the side areas, they may be in band shapes as illustrated in FIG. 5A, or they may also be in block shapes as illustrated in FIG. 6A. Furthermore, as illustrated in FIGS. 6B and 6C, it is desirable that each of the four colors of the image patterns 50 do not overlap, in order to ensure fixing ability.

Figure 6D:
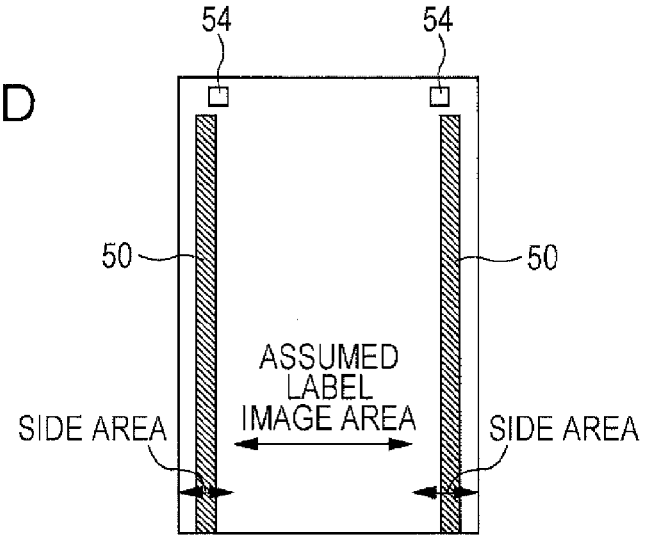
FIG. 6D is a diagram illustrating an example in which positioning patterns and the image patterns are formed at positions shifted from each other.

In the case where positioning marks or the like to be used in post-processing or the like are formed on the continuous paper P, it is desirable that the image patterns 50 are formed with characteristics different from the positioning marks, so as to avoid detection error such as confusion between the image patterns 50 and the positioning marks. The positioning marks may be formed by the image forming apparatus, and image formation may be performed according to image information on the continuous paper P on which the positioning marks are formed. For example, the image patterns 50 may be formed so as to have specific fixed positional relationships with the positioning marks, so that the image patterns 50 are not erroneously detected as the positioning marks. More specifically, as illustrated in FIG. 6D, it is desirable to form positioning marks 54 and the image patterns 50 so that they are distinguishable, by forming the image patterns 50 at positions shifted in the direction perpendicular to the conveying direction of the continuous paper P, with respect to the positioning marks 54. Furthermore, it is effective to form the positioning marks 54 and the image patterns 50 so that they do not overlap in the direction along the conveying direction of the continuous paper P. Alternatively, instead of arranging the positions to be formed, the positioning marks 54 and the image patterns 50 may be formed so that the sizes or the shapes differ from one another.

Because of the use of the continuous paper P, it is unable, when controlling the toner density, to form between images a patch or the like for controlling the toner density. In this exemplary embodiment, at the time when image formation starts, the toner density is adjusted by forming a patch for controlling the toner density on the intermediate transfer belt 44 and controlling the toner supply motor 62 on the basis of the detection result of the density sensor 48, and during image formation, due to an inability to form a patch, the toner density is adjusted based on the charged state and a change in the toner density estimated using a table prepared in advance or the like. For example, the density adjustment is made by controlling the toner supply motor 62 on the basis of the detection results of the pixel counter 64 and the toner density sensor 60.

Next, a basic image forming operation by the image forming apparatus 10 will be described.

When the image forming apparatus 10 receives a request of an image forming operation (printing), the image forming unit 24 including the four image forming parts 24Y, 24M, 24C, and 24K, the intermediate transfer unit 26, the secondary transfer unit 46, the fixing unit 28, and the like start.

Then, in the image forming unit 24, the photoconductor drum 30 is rotated first, with the surface of the photoconductor drum 30 being charged to a specific polarity and a specific potential by the charger 32. Next, the exposure part 34 applies light based on image information to the surface of the charged photoconductor drum 30, thereby an electrostatic latent image of the corresponding color component being formed on the surface of the photoconductor drum 30.

Then, the developing part 36 supplies to the electrostatic latent image with the corresponding color component formed on the surface of the photoconductor drum 30 toner of the corresponding color (Y, M, C, or K) charged to the specific polarity, which is then electrostatically adhered, and the electrostatic latent image is developed. The electrostatic latent image with the corresponding color component formed on the surface of the photoconductor drum 30 is thus manifested as a toner image in the corresponding color (Y, M, C, or K) developed by toner of the corresponding color.

When the toner image of the corresponding color formed on the photoconductor drum 30 of the image forming unit 24 is conveyed to the first transfer location, the first transfer part 38 performs first transfer of the toner image of the corresponding color in such a manner that the toner images of the individual colors overlap in order on the intermediate transfer belt 44.

Furthermore, after the first transfer finishes, in the image forming unit 24, the cleaner 40 removes the deposits, such as toner or the like, remaining on the surface of the photoconductor drum 30, and cleans the surface of the photoconductor drum 30. This enables the image forming unit 24 to proceed to the next image forming operation.

In the intermediate transfer unit 26, the toner images that have been subjected to first transfer by rotation of the intermediate transfer belt 44 are retained and conveyed to the secondary transfer location. In contrast, the paper feeder 12, prior to an image forming operation, supplies the continuous paper P from the paper feed roll 20 to the secondary transfer location along a specific conveyance path.

At the secondary transfer location, the secondary transfer unit 46 collectively performs secondary transfer of the toner images on the intermediate transfer belt 44 onto the continuous paper P. After the secondary transfer finishes, in the intermediate transfer unit 26, a cleaner which is not illustrated removes deposits, such as toner or the like, remaining on surface of the intermediate transfer belt 44 after the secondary transfer.

Then, the continuous paper P to which secondary transfer of the toner images have been performed is conveyed to the fixing unit 28. By a fixing process performed by the fixing unit 28, the toner images are fixed on the continuous paper P. In the end, the continuous paper P for which the fixing process is completed is ejected from the image forming device 14 and taken up into the storage roll 22 of the storage device 16.

Through the above operation, the continuous paper P on which a full color image of a combination of the four-color toner images is formed is output.

Figure 7:
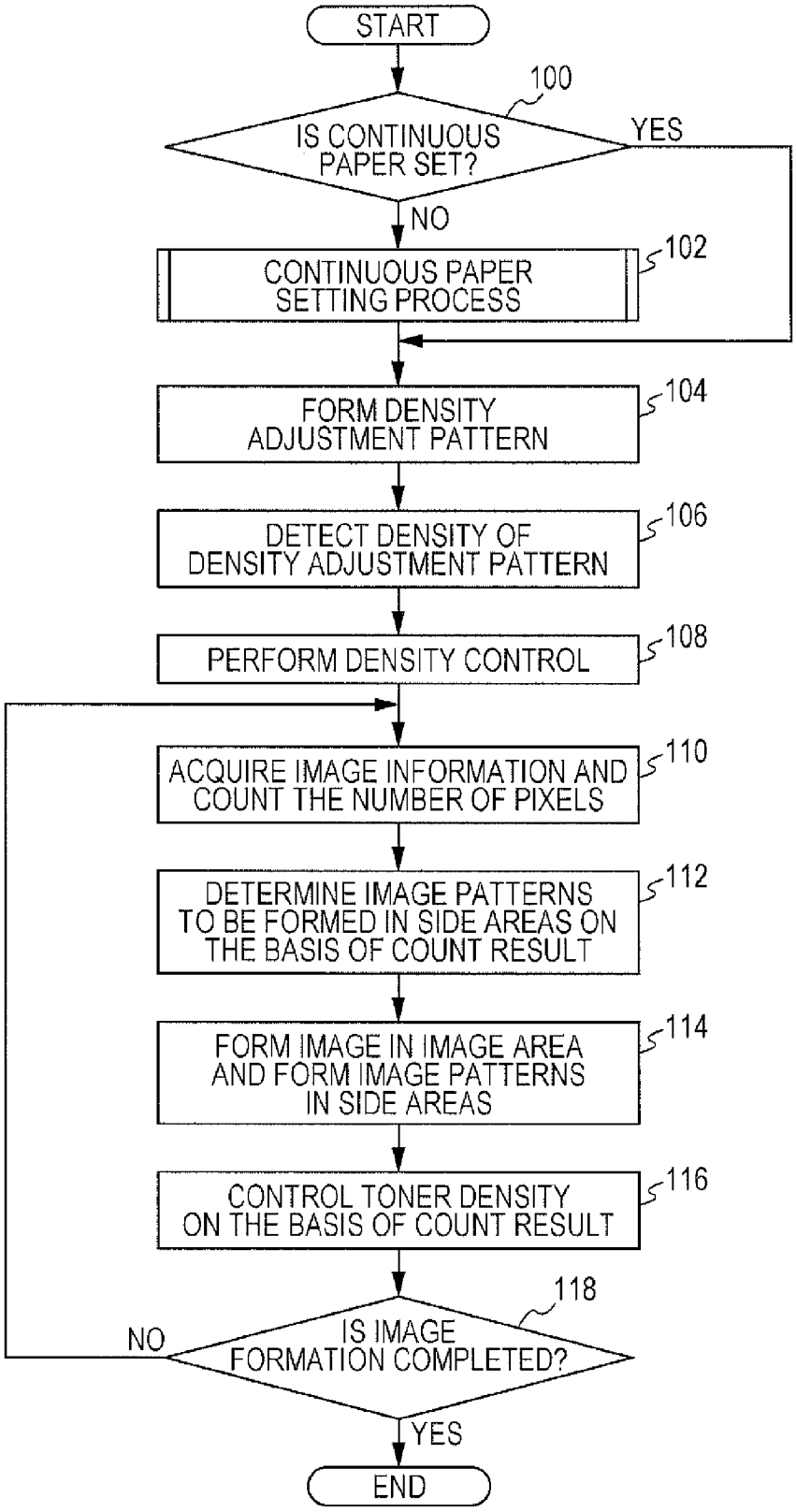
FIG. 7 is a flowchart illustrating an example of the flow of a process performed by a controller of an image forming apparatus according to the exemplary embodiment.

Next, a specific flow of a process performed by the controller 18 of the image forming apparatus 10 will be described. FIG. 7 is a flowchart illustrating an example of the flow of the process performed by the controller 18 of the image forming apparatus 10 according to this exemplary embodiment.

When an image forming instruction is issued, it is determined in step 100 whether or not the continuous paper P is set. For example, the determination is made based on a detection result of a paper detection sensor or the like. When a negative determination result is obtained, the process proceeds to step 102. When an affirmative determination result is obtained, the process proceeds to step 104.

In step 102, a specific continuous paper setting process for setting the continuous paper P is performed, and the process proceeds to step 104. In the continuous paper setting process, for example, each of the paper feeder 12, the image forming device 14, and the storage device 16 is controlled to convey the continuous paper P so that the continuous paper P is pulled out from the paper feed roll 20 of the paper feeder 12 and is stored into the storage device 16 through the image forming device 14.

In step 104, the image forming device 14 is controlled so that a specific density adjustment pattern is formed on the intermediate transfer belt 44. Then, the process proceeds to step 106.

In step 106, the density adjustment pattern is detected by the density sensor 48, and the process proceeds to step 108.

In step 108, the toner supply motor 62 is controlled and density adjustment is made based on the detection result of the density sensor 48. Then, the process proceeds to step 110. In this exemplary embodiment, density control is performed by causing the density sensor 48 to detect the density of the density adjustment pattern formed on the intermediate transfer belt 44. However, density control may be performed by forming a density adjustment pattern on the continuous paper P and then detecting the density of the density adjustment pattern formed on the continuous paper P. Furthermore, density control based on the detection result of the density sensor 48 may be performed during the continuous paper setting process in step 102.

Next, in step 110, image information is acquired, and the pixel counter 64 counts the number of pixels. Then, the process proceeds to step 112. The pixel counter 64 is described here as a device to count the number of pixels of the image information. However, the pixel counter 64 is not limited to this. The pixel counter 64 may count the lighting time of the exposure part 34.

In step 112, the image patterns 50 to be formed in side areas are determined based on the count result of the pixel counter 64, and the process proceeds to step 114. For example, when the area coverage is smaller than or equal to a threshold, the image patterns 50 having a size equal to or greater than a threshold are determined. In this case, for example, the image patterns 50 may be determined in such a manner that the amounts of toner discharged are the same among individual colors by determining the image patterns 50 such that a large amount of toner is discharged for the color with a small area coverage and that a small amount of toner or no toner is discharged for the color with a large area coverage. In the case where a toner discharge amount for a certain color exceeds a specific amount (for example, an area coverage of 8 percent), the toner discharge amount of the other colors may be fixed to the above-mentioned specific amount. Furthermore, when determining the image patterns 50, the positions at which the image patterns 50 are formed may also be determined according to the paper width of the continuous paper P. For example, the positions where the image patterns 50 are formed may be corrected for every paper width, on the basis of the detection result of a detecting unit, such as a paper-width detection sensor, or the result of paper-width specification by a user using a specifying unit, such as an operation unit of the controller 18, which specifies the paper width. Accordingly, the image patterns 50 may be formed in side areas even when the continuous paper P of different paper widths is used.

Alternatively, the image patterns 50 may be formed by determining the positions at which the image patterns 50 are formed not according to the width of the continuous paper P but according to the size of images formed on the continuous paper P.

In step 114, each part of the image forming unit 24 is controlled such that images are formed in the image area and the image patterns 50 are formed in side areas, and the process proceeds to step 116.

In step 116, the toner density is controlled based on the count result of the pixel counter 64 including the image patterns 50, and the process proceeds to step 118. In other words, by controlling the toner supply motor 62 on the basis of the count result of the pixel counter 64, control of the toner density during image formation is performed.

In step 118, it is determined whether or not image formation is completed. When a negative determination result is obtained, the process returns to step 110 and the above-mentioned processing steps are repeated. When an affirmative determination result is obtained, the series of processing steps is terminated.

As described above, in the image forming apparatus 10 according to this exemplary embodiment, by forming the image patterns 50 in side areas of the continuous paper P, the circulation of the toner is urged and the degradation of the toner is suppressed.

Furthermore, as described above, the toner includes an external additive, which is sandwiched between the blade 41 and the photoconductor drum 30 and functions as a lubricant for suppressing friction of the blade 41. When the toner degrades, the external additive will be buried in the toner and the performance of the external additive to suppress friction of the blade 41 may be undermined. However, in this exemplary embodiment, due to the formation of the image patterns 50 in side areas of the continuous paper P, the degradation of the toner will be suppressed, thus preventing the external additive being buried in the toner. Accordingly, the friction suppression performance of the blade 41 is maintained.

In the above exemplary embodiment, the described example assumes label paper as the continuous paper P in which side areas in which the image patterns 50 are formed are to be removed. However, the continuous paper P is not necessarily label paper. The continuous paper P of another type may be used. For example, continuous form paper or the like may be employed and side areas in which the image patterns 50 are formed may be cut off by post-processing or the like.

Furthermore, the process performed by the controller 18 of the image forming apparatus 10 in the above exemplary embodiment may be stored as a program in a storage medium and distributed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a continuous recording medium by transferring to the continuous recording medium a toner image obtained by developing a latent image formed on a photoreceptor; and a controller that controls the image forming unit such that an image based on image information is formed in a specific image area on the continuous recording medium, and at the same time, a specific image pattern is formed in a specific side area outside the image area on the continuous recording medium, wherein an amount of toner used as the specific image pattern formed in the specific side area is determined by an amount of toner used as the image formed in the specific image area, and a size of the specific image pattern formed in the specific side area outside the image area is controlled based on an area coverage amount of the image formed in the specific image area.

2. The image forming apparatus according to claim 1, wherein the controller controls the image forming apparatus to form, as the image pattern, an image pattern having a size which provides a toner discharge amount equal to or greater than a specific threshold.

3. The image forming apparatus according to claim 1, further comprising:

at least one of a detecting unit that detects the width of the continuous recording medium and a specifying unit that specifies the width of the continuous recording medium, wherein the controller performs control such that a position of the side area at which the image pattern is formed is modified on the basis of the width of the continuous recording medium detected by the detecting unit or the width of the continuous recording medium specified by the specifying unit.

4. The image forming apparatus according to claim 2, further comprising:

at least one of a detecting unit that detects the width of the continuous recording medium and a specifying unit that specifies the width of the continuous recording medium, wherein the controller performs control such that a position of the side area at which the image pattern is formed is modified on the basis of the width of the continuous recording medium detected by the detecting unit or the width of the continuous recording medium specified by the specifying unit.

5. The image forming apparatus according to claim 1, wherein the image forming unit includes a plurality of image forming parts that form images of different colors, and wherein the controller controls the image forming unit such that each of the image forming parts forms the image pattern having a size which provides a same toner discharge amount among the plurality of image forming parts.

6. The image forming apparatus according to claim 2, wherein the image forming unit includes a plurality of image forming parts that form images of different colors, and wherein the controller controls the image forming unit such that each of the image forming parts forms the image pattern having a size which provides a same toner discharge amount among the plurality of image forming parts.

7. The image forming apparatus according to claim 3, wherein the image forming unit includes a plurality of image forming parts that form images of different colors, and wherein the controller controls the image forming unit such that each of the image forming parts forms the image pattern having a size which provides a same toner discharge amount among the plurality of image forming parts.

8. The image forming apparatus according to claim 4, wherein the image forming unit includes a plurality of image forming parts that form images of different colors, and wherein the controller controls the image forming unit such that each of the image forming parts forms the image pattern having a size which provides a same toner discharge amount among the plurality of image forming parts.

9. The image forming apparatus according to claim 1, wherein the controller controls the image forming unit to form positioning marks to be used in specific post-processing after image formation on the continuous recording medium in such a manner that the positioning marks are different from the image pattern.

10. The image forming apparatus according to claim 2, wherein the controller controls the image forming unit to form positioning marks to be used in specific post-processing after image formation on the continuous recording medium in such a manner that the positioning marks are different from the image pattern.

11. The image forming apparatus according to claim 3, wherein the controller controls the image forming unit to form positioning marks to be used in specific post-processing after image formation on the continuous recording medium in such a manner that the positioning marks are different from the image pattern.

12. The image forming apparatus according to claim 4, wherein the controller controls the image forming unit to form positioning marks to be used in specific post-processing after image formation on the continuous recording medium in such a manner that the positioning marks are different from the image pattern.

13. The image forming apparatus according to claim 5, wherein the controller controls the image forming unit to form positioning marks to be used in specific post-processing after image formation on the continuous recording medium in such a manner that the positioning marks are different from the image pattern.

14. The image forming apparatus according to claim 6, wherein the controller controls the image forming unit to form positioning marks to be used in specific post-processing after image formation on the continuous recording medium in such a manner that the positioning marks are different from the image pattern.

15. The image forming apparatus according to claim 7, wherein the controller controls the image forming unit to form positioning marks to be used in specific post-processing after image formation on the continuous recording medium in such a manner that the positioning marks are different from the image pattern.

16. The image forming apparatus according to claim 8, wherein the controller controls the image forming unit to form positioning marks to be used in specific post-processing after image formation on the continuous recording medium in such a manner that the positioning marks are different from the image pattern.

17. An image forming method comprising:

forming an image on a continuous recording medium by transferring to the continuous recording medium a toner image obtained by developing a latent image formed on a photoreceptor; and performing control such that an image based on image information is formed in a specific image area on the continuous recording medium, and at the same time, a specific image pattern is formed in a specific side area outside the image area on the continuous recording medium, wherein an amount of toner used as the specific image pattern formed in the specific side area is determined by an amount of toner used as the image formed in the specific image area, and a size of the specific image pattern formed in the specific side area outside the image area is controlled based on an area coverage amount of the image formed in the specific image area.

18. A non-transitory computer readable medium storing a program causing a computer to execute a process for image formation, the process comprising:

forming an image on a continuous recording medium by transferring to the continuous recording medium a toner image obtained by developing a latent image formed on a photoreceptor; and performing control such that an image based on image information is formed in a specific image area on the continuous recording medium, and at the same time, a specific image pattern is formed in a specific side area outside the image area on the continuous recording medium, wherein an amount of toner used as the specific image pattern formed in the specific side area is determined by an amount of toner used as the image formed in the specific image area, and a size of the specific image pattern formed in the specific side area outside the image area is controlled based on an area coverage amount of the image formed in the specific image area.

* * * * *